US007775001B2

(12) United States Patent
Milliken et al.

(10) Patent No.: US 7,775,001 B2
(45) Date of Patent: Aug. 17, 2010

(54) STORM PANEL APPARATUS

(76) Inventors: Shawn Milliken, 710 Buckskin Ct., Englewood, FL (US) 34223; Les Milliken, 1085 S. Boundary Blvd., Rotonda, FL (US) 33947; Kim Smiley, 4016 Rolling Oak Dr., Lakeland, FL (US) 33810

( * ) Notice: Subject to any disclaimer, the term of this patent is extended or adjusted under 35 U.S.C. 154(b) by 174 days.

(21) Appl. No.: 11/844,610

(22) Filed: Aug. 24, 2007
(Under 37 CFR 1.47)

(65) Prior Publication Data

US 2009/0049772 A1 Feb. 26, 2009

(51) Int. Cl.
*E06B 3/26* (2006.01)

(52) U.S. Cl. ..... 52/202; 52/630

(58) Field of Classification Search ..... 52/202, 52/783.11, 789.12, 784.1, 789.1, 798.1, DIG. 12, 52/630; 49/57; 428/593, 603, 182, 183
See application file for complete search history.

(56) References Cited

U.S. PATENT DOCUMENTS 3,660,482 A * 5/1972 Elizalde ..... 52/537
3,760,549 A * 9/1973 Silberkuhl et al. ..... 52/630
4,453,364 A * 6/1984 Ting ..... 52/630
4,962,622 A * 10/1990 Albrecht et al. ..... 52/630
5,524,409 A * 6/1996 Kaiser ..... 52/588.1
5,596,849 A * 1/1997 Hill ..... 52/202
5,768,833 A * 6/1998 Golen ..... 52/202
5,855,099 A * 1/1999 Hoffman ..... 52/202
5,927,028 A * 7/1999 Rossi ..... 52/202
5,996,292 A * 12/1999 Hill et al. ..... 52/202
2006/0179737 A1 * 8/2006 Trundle ..... 52/202

* cited by examiner

*Primary Examiner*—D. Dunn
*Assistant Examiner*—Christine T Cajilig
(74) *Attorney, Agent, or Firm*—Donald R. Piper, Jr.; Dann Dorfman Herrell & Skillman, P.C.

(57) ABSTRACT

A storm panel is provided for shielding a structure. The storm panel includes at least one corrugation, and comprises a first wall and a second wall disposed in spaced-apart relation. An angled wall is disposed between and connected to the first wall and the second wall to support the second wall away from the first wall. At least one ridge is disposed proximate the point of connection between the second wall and the angled wall, and may have a shape configured to strengthen the panel proximate the point of connection between the second wall and the angled wall. In addition, a storm panel assembly is provided comprising at least one storm panel and a mounting extrusion for attachment to the storm panel to provide support for the storm panel on a mounting surface, such as the side of a building.

19 Claims, 17 Drawing Sheets

STORM PANEL APPARATUS

FIELD OF THE INVENTION

The present invention relates to a storm panel apparatus for protecting structures during hurricanes and other storms.

BACKGROUND OF THE INVENTION

Each year, storms cause a great deal of property damage. Property owners spend vast amounts of money to repair buildings after storms, particularly in hurricane-prone coastal regions. Violent storms can cause glass windows and doors to shatter and break. Although plywood is commonly used to board up windows and doors before a storm, the use of plywood has drawbacks. For instance, plywood can rot when it gets wet. Plywood is not well-suited for re-use through several storms. Also, plywood may be in short supply if a storm is predicted to hit a given area. Accordingly, it is desirable to use a durable, re-usable, reliable apparatus for shielding windows and doors from storm damage.

SUMMARY OF THE INVENTION

In accordance with the present invention, an apparatus is provided for protecting structures from damage, particularly damage caused by storms. The apparatus of the present invention functions to shield structures, such as windows and doors from debris, high winds, and heavy rain which may damage or break the windows and doors.

In one of its aspects the present invention provides a storm panel for shielding a structure. The storm panel includes at least one corrugation and comprises a first wall and a second wall disposed in spaced-apart relation. An angled wall is disposed between and connected to the first wall and the second wall to support the second wall away from the first wall. At least one ridge is disposed proximate the point of connection between the second wall and the angled wall, and may have a shape configured to strengthen the panel proximate the point of connection between the second wall and the angled wall. Additionally, the ridge may be disposed at the point of connection between the second wall and the angled wall to connect the second wall to the angled wall. The storm panels of the present invention may be configured so that a series of panels may be joined together to form a sheet of storm panels in order to cover a structure that is larger than a single storm panel or to provide additional strength.

In addition, in another aspect of the present invention a storm panel assembly is provided comprising at least one storm panel and a mounting extrusion for attachment to the at least one storm panel to provide support for the at least one storm panel on a mounting surface, such as the side of a building, for example. The storm panel includes at least one corrugation, and comprises a first wall and a second wall disposed in spaced-apart relation, an angled wall disposed between and connected to the first wall and the second wall to support the second wall away from the first wall, and, at least one ridge disposed proximate the point of connection between the second wall and the angled wall. The mounting extrusion may take a variety of suitable forms. For example, the mounting extrusion may include a cavity dimensioned to receive a fastener and may have a slot configured to permit the fastener to extend therethrough for attachment to the at least one storm panel. Also, the mounting extrusion may include a mounting arm extending away from the cavity for mounting to the mounting surface. In a further configuration of an exemplary mounting extrusion, the mounting extrusion may include a mounting arm for mounting to the mounting surface, an extension arm connected to and extending away from the mounting arm, and a panel retention arm connected to and extending away from the extension arm. The mounting arm, extension arm, and panel retention arm may cooperate to provide a cavity for receiving the at least one storm panel.

BRIEF DESCRIPTION OF THE DRAWINGS

The foregoing summary and the following detailed description of the preferred configurations of the present invention will be best understood when read in conjunction with the appended drawings, in which.

DETAILED DESCRIPTION OF THE INVENTION

Figure 1A:
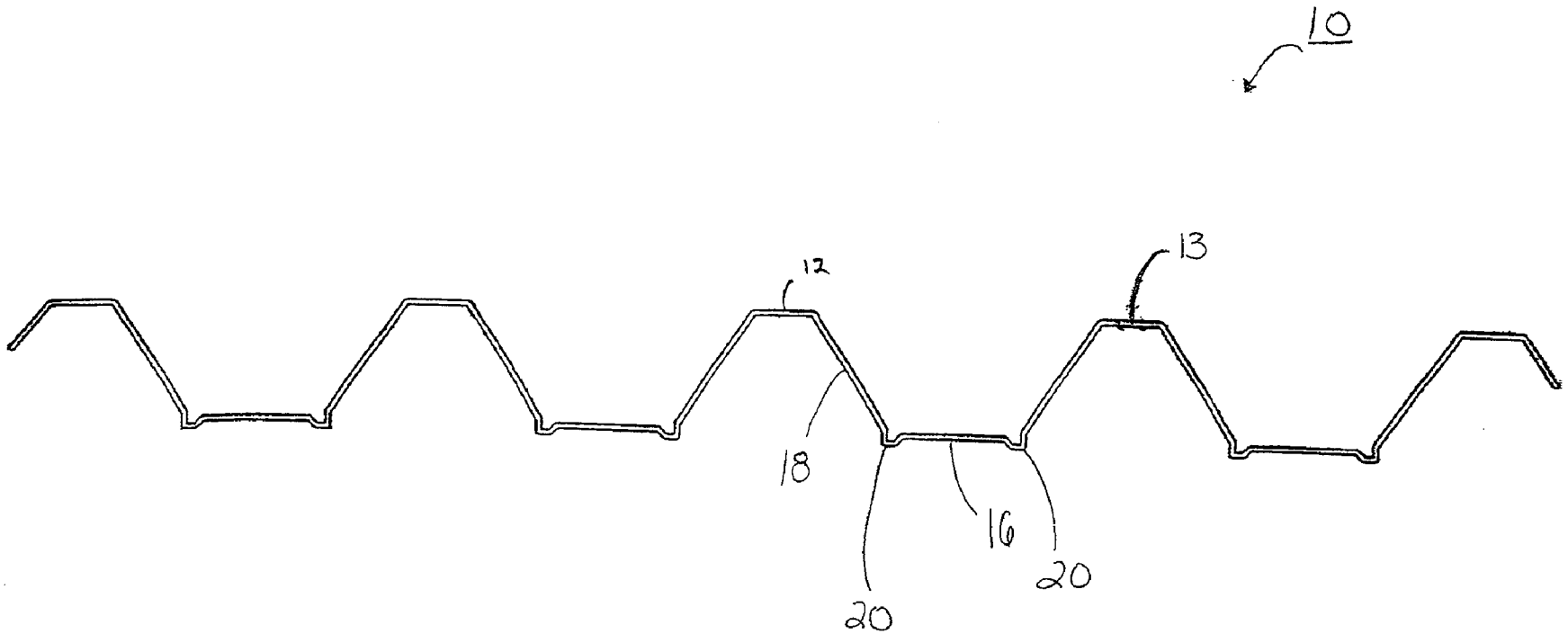
FIG. 1A is an end view of a storm panel in accordance with the present invention.
Figure 1B:
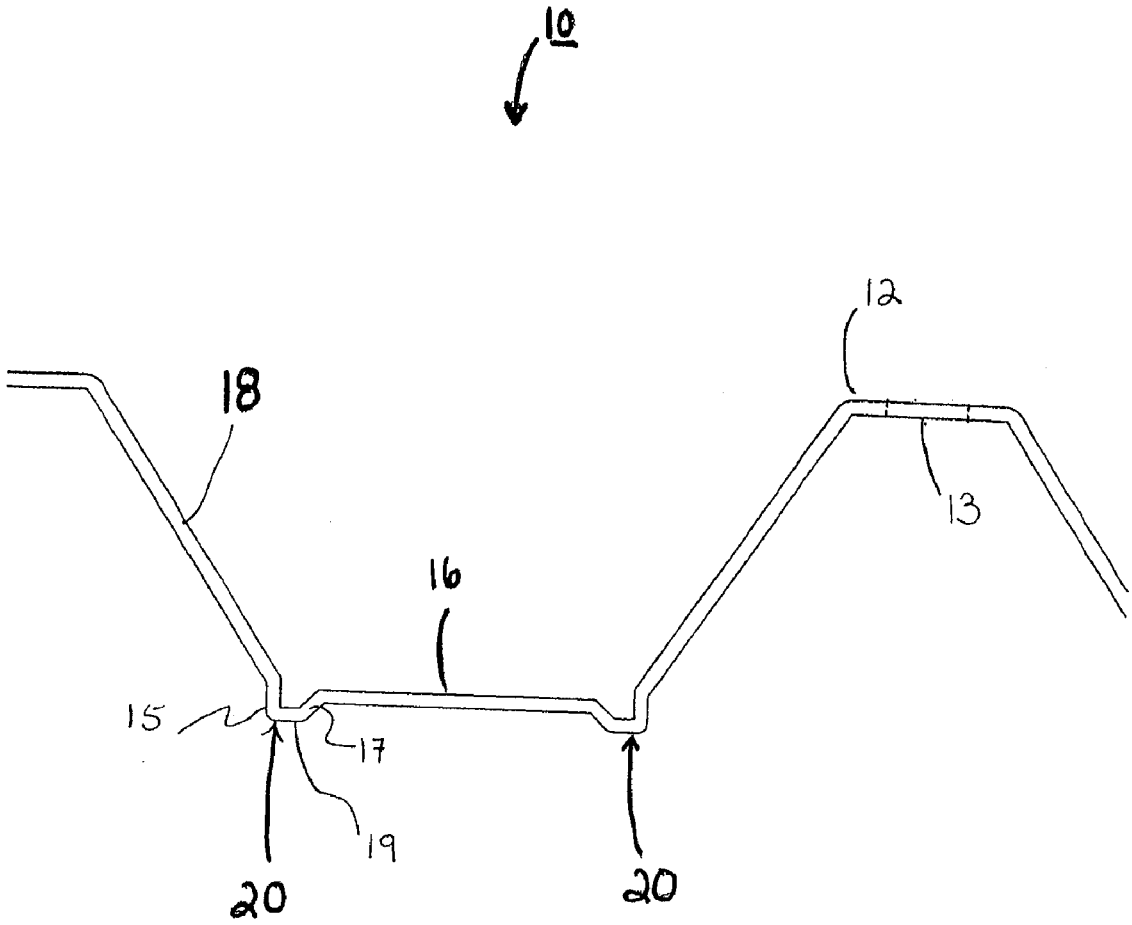
FIG. 1B is an enlarged top view of a portion of the storm panel FIG. 1A.

Referring now to the Figures in general, wherein like reference numerals refer to the same components across the several views, in FIG. 1A an exemplary configuration of a corrugated storm panel 10 for shielding a structure is illustrated. The storm panel 10 has a first wall 12 for optionally mounting closest to the structure to be protected and a second wall 16 spaced-apart from the first wall 12. The first and second walls 12, 16 may have a generally planar shape and may be oriented parallel to one another. Alternatively, the first and second walls 12, 16 may have a non-planar shape and/or may be oriented in nonparallel relation to one another. An angled wall 18 may be positioned between the first wall 12 and the second wall 16 and may be connected directly or indirectly to the first and second walls 12, 16. Between angled wall 18 and at least one of the first wall 12 and the second wall 16 is at least one ridge 20. For example, the ridge 20 may be provided proximate to or at the point of connection between the angled wall 18 and second wall 16 for indirectly connecting the angled wall 18 to the second wall 16, as illustrated in FIG. 1B. (If the ridge 20 were located proximate to the point of connection between the angled wall 18 and one of the first and second walls 12, 16, the ridge 20 could be located entirely along the angled wall 18, first wall 12, or second wall 16.) In contrast, the first wall 12 (or second wall 16) and angled wall 18 may be directly connected without an intermediate ridge, though a ridge may be provided proximate the point of connection between the angled wall 18 and the first wall 12. The storm panel 10 may include ridges 20 at each point of connection between the angled wall 18 and the first wall 12, as illustrated in FIG. 1A, or the ridges 20 may be provided at fewer than each of the points of connection of the first and second walls 12, 16 with the angled wall 18.

The ridge 20 may have a configuration that strengthens the storm panel 10 proximate the point of connection between the angled wall 18 and the first and second walls 12, 16. The presence of one or more ridges 20 along the second wall 16 can provide increased stability and strength to the outwardly projecting second wall 16 of the storm panel 10, thereby reducing the likelihood the storm panel 10 will break or allow any projectile or other debris to penetrate the panel. In another configuration, a corrugation of the panel 10 has two ridges 20. See FIGS. 1A and 1B. The two ridges may be spaced along the second wall 16. Added stability is particularly important during storms when high winds, debris, and heavy rains could damage the storm panel 10 and possibly damage the structure over which the storm panel 10 is mounted.

For example, the presence of ridges 20 on the storm panel 10 of the present invention decreases the ability of high winds present during a storm to suck or pull the storm panel 10 off of the structure to which it is mounted. Specifically, it is believed that the presence of the ridges 20 on the storm panel 10 decreases the formation of a localized low pressure area over the storm panel 10 that would otherwise be caused by the passage of high velocity winds over the surface of the storm panel 10. In this regard, the ridges 20 are believed to disrupt the airflow over the storm panel 10 causing turbulence that would deter the formation of a localized low pressure area that one might expect to occur by operation of the Bernoulli principle. In addition, since the presence of ridges 20 on the storm panel 10 can decrease the sucking or pulling force that high winds exert on the storm panels 10 of the present invention, the storm panel 10 of the present invention experiences less repeated bowing and flexing during a storm which is a significant cause of weakening and loosening the storm panel. Moreover, by decreasing the tendency for the storm panel to bow and flex, the likelihood of setting up a resonant frequency that would seriously compromise the integrity of the storm panel is greatly reduced.

The ridge 20 may have a first wall 15 in contact with the angled wall 18 at a first end of the ridge 20 and a second wall 17 in contact with the second wall 16 at a second end of the ridge 20 with an intermediate wall 19 disposed therebetween to provide a generally U-shaped ridge 20, FIG. 1B. Specifically, FIG. 1B depicts an enlarged view of part of a corrugation having two ridges 20 with ridges projecting outwards from both the angled wall 18 and the second wall 16 to form a shape similar to a bastion. Though the ridge walls 15, 17, 19 are illustrated as being generally planar, the ridge walls 15, 17, 19 may also have a non-planar shape. In addition, the ridges 20 could include a greater or lesser number of ridge walls to form other shapes, such as triangles or squares.

An exemplary storm panel 10 may include the following dimensions. For example, one period of the repeating corrugation can extend approximately 6 inches along the length of the panel 10. The first wall 12 can measure approximately 1 inch across, the second wall 16 can measure approximately 2.5 inches across, and the depth of the storm panel 10 from the outer surface of the first wall 12 to the outer surface of the second wall 16 can be approximately 2.25 inches. The panels 10 may be vacuum formed and have a minimum average wall thickness of 0.080 inches. The storm panel 10 is desirably impact resistant in order to protect the underlying structure from flying debris, high winds, and heavy downpours. For instance, the storm panel 10 may comprise a polymeric material, such as a plastic like polycarbonate or polymethyl methacrylate (PMMA).

Figure 2:
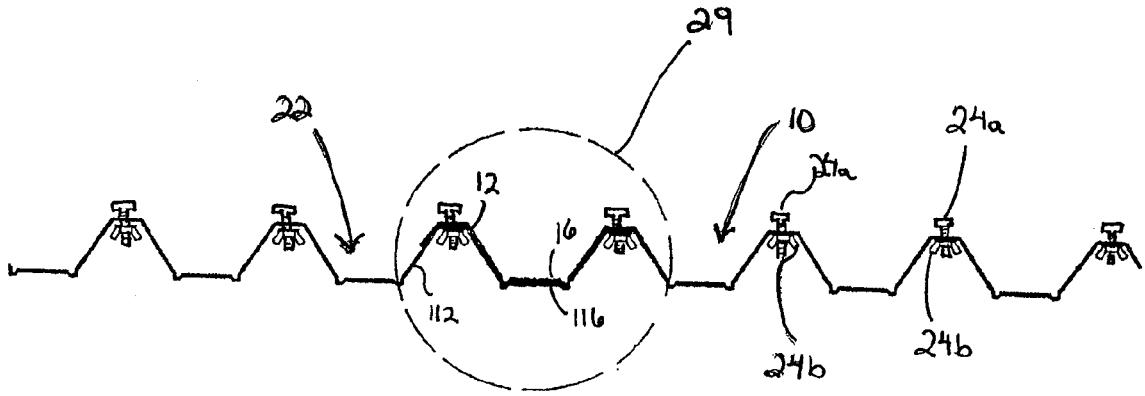
FIG. 2 is an end view of two storm panels of FIG. 1A with a portion of the panels overlapping to join the panels together.

To facilitate mounting of the storm panel 10 to the structure to be protected, the storm panel 10 may optionally include a mounting feature, such as a slot 13, disposed in the first wall 12 for receiving a fastener 24*a*, such as a bolt, FIGS. 1B, 2. The fastener 24*a* can slide through the slot 13 to fasten the storm panel 10 onto a mounting surface. Another fastener 24*b*, such as a wing nut, can also secure the bolt 24*a* to the storm panel onto a mounting surface. The slot 13 may be approximately 1 inch long and 0.313 inches wide. The storm panel 10 can be mounted onto a structure so that the corrugations run in a vertical direction in relation to the structure, or the storm panel 10 can be installed so that the corrugations run in a horizontal direction.

Fasteners 24*a* can anchor the panel 10 to various structures, such as a wall, threshold, or lintel. For instance, the fastener 24*a* can be directly fastened into poured concrete, a concrete block, or both poured concrete and a concrete block for mounting a storm panel 10. The fasteners 24*a* can also anchor the storm panel 10 to pavers, bricks, or other pre-cast products, stucco, poured concrete, wood, or any other building material which can serve as a support. Alternatively, the fastener 24*a* can be directly attached into a wooden wall mount, such as a wood header or a wooden plate. Various types of fasteners 24*a* can be used including wood screws, bolts including hex bolts, head wood screws, and other fasteners. Additionally, various types of fasteners, such as wing nuts 24*b*, may be used. Screws may be stainless steel or corrosion resistant coated carbon steel, and bolts may be galvanized or stainless steel.

A plurality of storm panels 10 can be joined together to form a sheet of storm panels 10, with a first storm panel 10 overlapping a second panel 22 at a lap joint 29, FIG. 2. The first wall 12 and second wall 16 of a first storm panel 10 can overlap a respective first wall 112 and second wall 116 of a second storm panel 22. In one desirable configuration the panels 10, 22 overlap for at least one full period. Optionally, fasteners 24*a*, 24*b* may be used at the lap joint 29. While FIG. 2 depicts the overlapping panels 10 and 22 as both having the same orientation, it can be appreciated by one skilled in the art that the panels 10 could also have a reverse orientation. That is, FIG. 2 depicts the first wall 12 of storm panel 10 and the first wall 112 of panel 22 as both facing towards the top of the figure, showing the panels 10, 22 as having the same orientation. Alternatively, the panels 10, 22 could have a reverse orientation in which the first wall 12 of storm panel 10 could face towards the top of the figure and the first wall 112 of panel 22 could face towards the bottom of the figure.

Generally, the storm panels 10 may be mounted onto a structure over a cavity, such as one containing a recessed window or door to provide a minimum of one inch separation between the storm panel 10 and the recessed window or door. However, in some instances laying storm panels 10 directly onto a structure will not provide a one inch gap. In other situations, the construction of a building does not readily permit a storm panel 10 to be directly mounted thereon. In situations such as these, a mounting extrusion can be used to support a panel 10 or series of panels 10 to the structure to create an appropriately-sized space between the storm panel 10 and the structure. Accordingly, the present invention provides a storm panel assembly comprising at least one storm panel 10 and one or more mounting extrusions for mounting the storm panel 10 to a mounting surface of the structure. The mounting extrusions can provide additional support for a storm panel 10 and can create a desired gap, such as a 1 inch gap, between the storm panel 10 and the structure.

Turning to FIGS. 3-8 different mounting extrusions for use in a storm panel assembly of the present invention are illustrated. For example, mounting extrusions for use with the present invention include a build-out F-track, an F-track, an H-header, a U-header, a studded angle, and a build-out H-header mounting extrusion, FIGS. 3-8, respectively. The extrusions may be constructed from aluminum though other suitable materials may be used.

Figure 3:
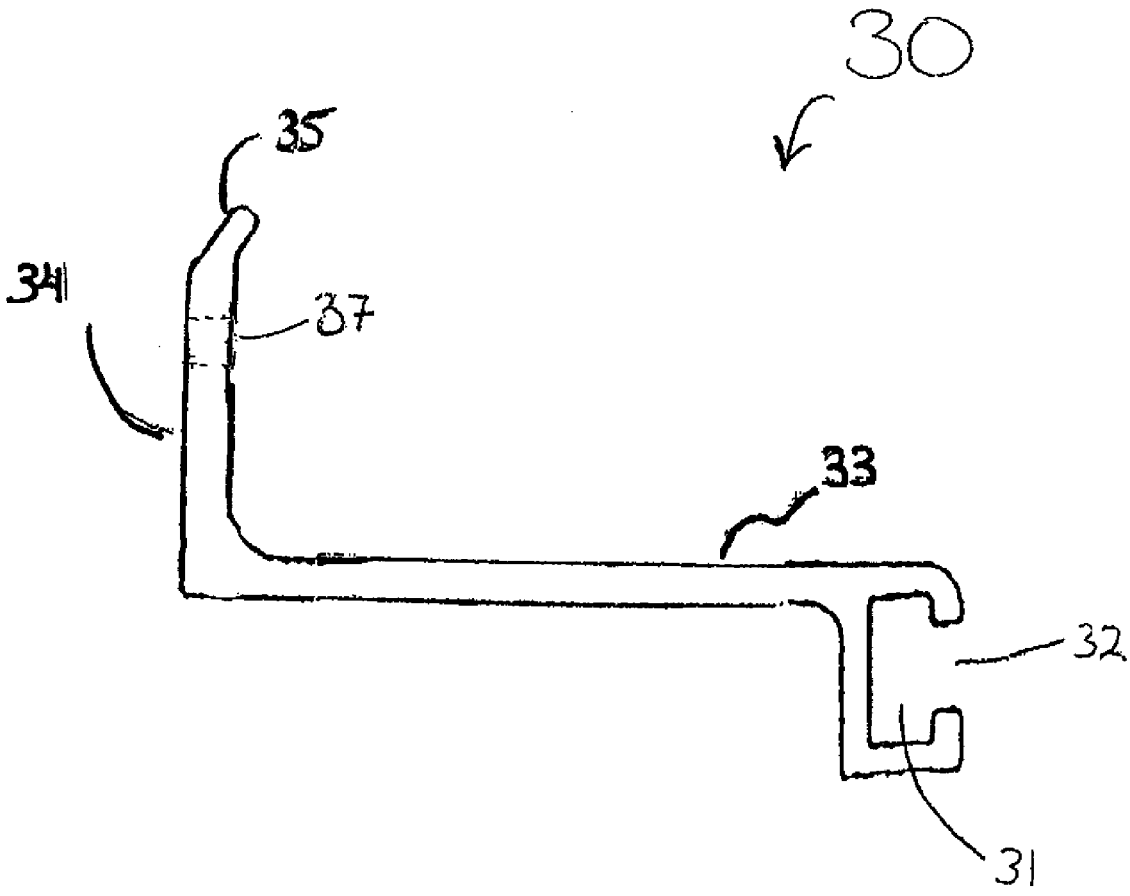
FIG. 3 is an end view of a build-out F-track mounting extrusion.

The build-out F-track extrusion 30 includes a cavity 31 having a slot 32, an extension arm 33, a mounting arm 34, and an optional angled tip 35, FIG. 3. The cavity 31 is dimensioned to receive a fastener 24*a*, such as a bolt, through the slot 32 so that the fastener 24*a* can secure the storm panel 10 onto the F-track extrusion 30, FIG. 10. Another fastener 24*b* such as a wing nut can also be used to secure the bolt 24*a* to the F-track extrusion 30. The mounting arm 34 of the extrusion 30 may also include a mounting feature, such as a slot or hole 37, in the mounting arm 34 to allow a fastener 25 to secure the extrusion 30 onto a supporting structure 90. For instance, the build-out F-track extrusion 30 may be mounted on a wall made of poured concrete, concrete block, or both poured concrete and concrete block. Alternatively, the build-out F-track extrusion 30 can be mounted onto a wooden wall having a wooden header or wooden plate.

The build-out F-track extrusion 30 can be modified to provide for a lengthened extension arm 33 or a lengthened mounting arm 34. In a preferred configuration, the length of the extension arm 33 may be varied depending upon which surface the extrusion is mounted. For example, the extension arm 33 can be 1 inch, 2 inches, or 3 inches, depending upon the structural features of a particular mounting surface. Additionally, the mounting arm 34 can be lengthened or the dimensions of the extrusion 30 otherwise modified to support a variety of panels 10.

Figure 8:
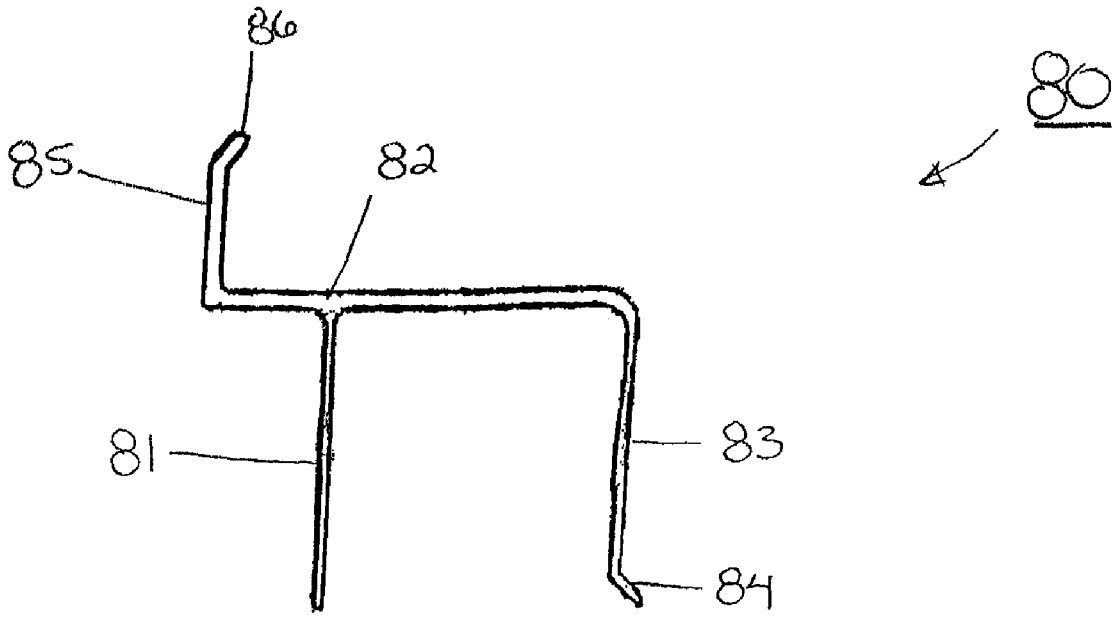
FIG. 8 is an end view of a build-out H-header mounting extrusion.
Figure 10:
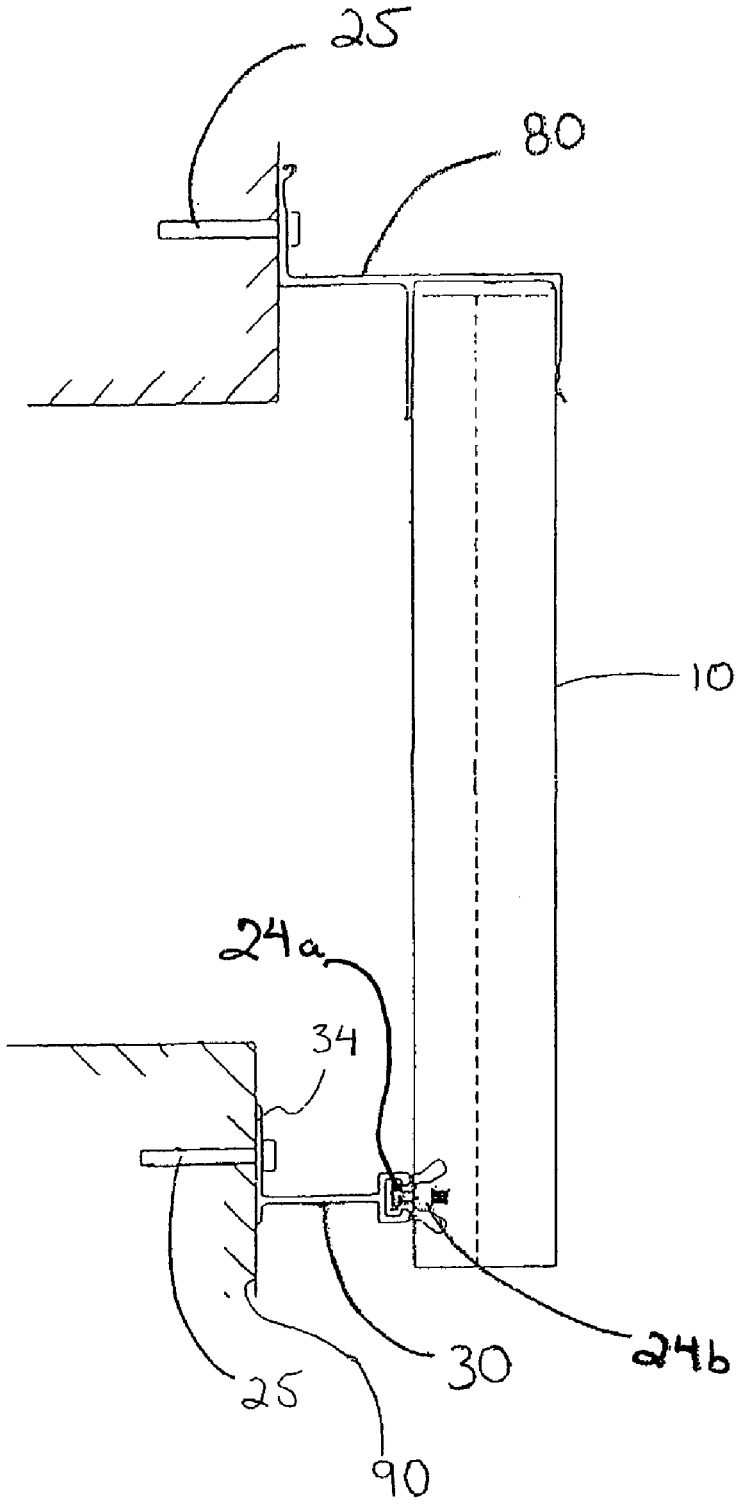
FIG. 10 is a side-elevational view of a storm panel mounted to a mounting surface, such as the side of a building, using a build-out F-track and a build-out H-header mounting extrusion.

In addition, another extrusion that may be used with the storm panels 10 of the present invention is a build-out H-header mounting extrusion 80, FIG. 8, 10. The build-out H-header mounting extrusion 80 may be used alone or in combination with other extrusions, such as the F-track extrusion 30, FIG. 10. For instance, one end of the panel 10 can be mounted to the build-out H-header mounting extrusion 80, while another end of the panel 10 is mounted to the F-track extrusion 30. The build-out H-header mounting extrusion 80 includes an interior panel retention arm 81, an extension arm 82 extending from the interior panel retention arm 81, and an exterior panel retention arm 83 extending from the second arm and spaced apart from the interior panel retention arm 81. A mounting arm 85 extends from the extension arm 82.

The exterior panel retention arm 83 and the mounting arm 85 may each include an angled tip 84, 86. The angled tip 84 may act as a cam to guide and wedge storm panel 10 into the space between the interior panel retention arm 81 and the exterior panel retention arm 83. The tip 84 eases the storm panel 10 into the space thereby creating a snug fit between the panel 10 and the interior and exterior panel retention arms 81, 83 to assist in holding the storm panel 10 in place during a storm which may include high winds. Accordingly, the snug fit created between the mounting surface and the panel protects the panel from blowing away during a storm. A snug fit also impedes the collection of rainwater between the panel 10 and the structure upon which the panel 10 is mounted. Further, the angled tip 84 creates a lip over the storm panel 10 so that rain that hits the extrusion 80 runs down the panel 10, FIG. 10.

Figure 4:
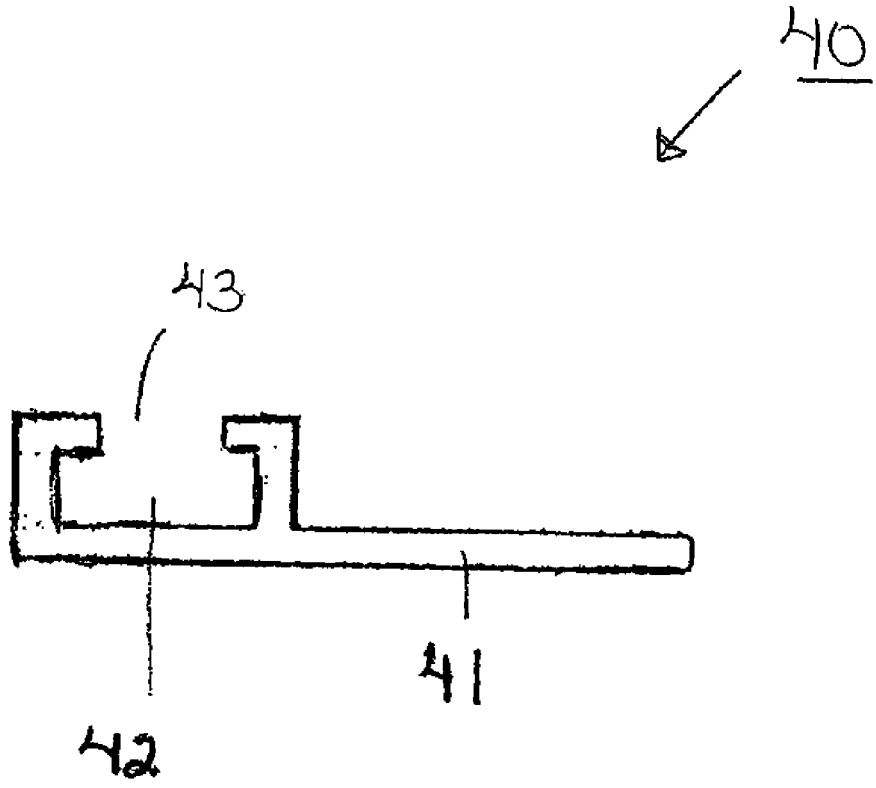
FIG. 4 is an end view of an F-track mounting extrusion.
Figure 12:
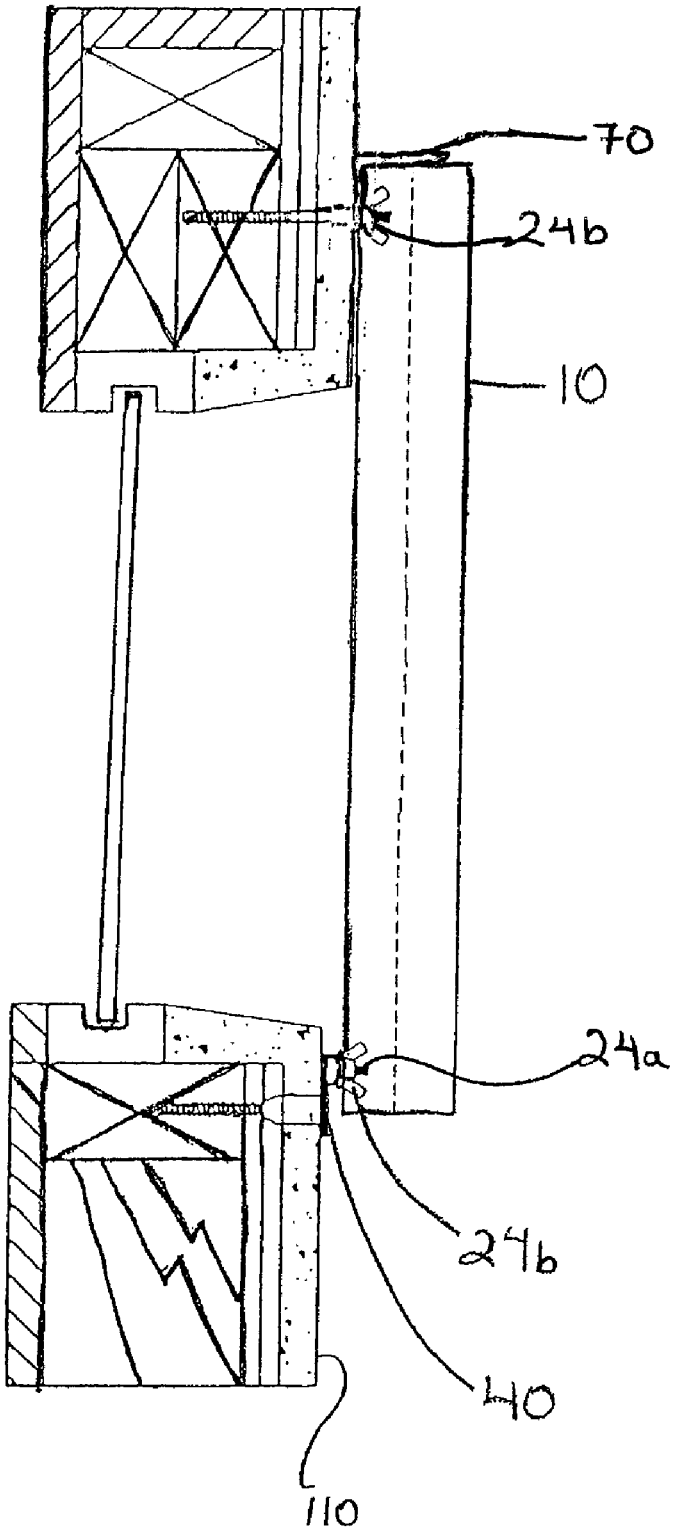
FIG. 12 is a side-elevational view of a storm panel mounted to a mounting surface, such as the side of a building, using a studded angle mounting extrusion and an F-track mounting extrusion

A further extrusion that may be used with the storm panels 10 of the present invention is an F-track mounting extrusion 40, FIGS. 4, 12. The F-track mounting extrusion 40 includes a cavity 42 having a slot 43 and a mounting arm 41 that extends from the cavity 42. As with the build-out F-track extrusion 30, the cavity 42 is dimensioned to receive a fastener 24*a*, such as a bolt, through the slot 43 so that the fastener 24*a* can secure the storm panel 10 onto the F-track extrusion 40 and onto a supporting structure 110, FIG. 12. Further, a wing nut 24*b* can be used to secure the fastener 24*a* to the storm panel 10.

Figure 5:
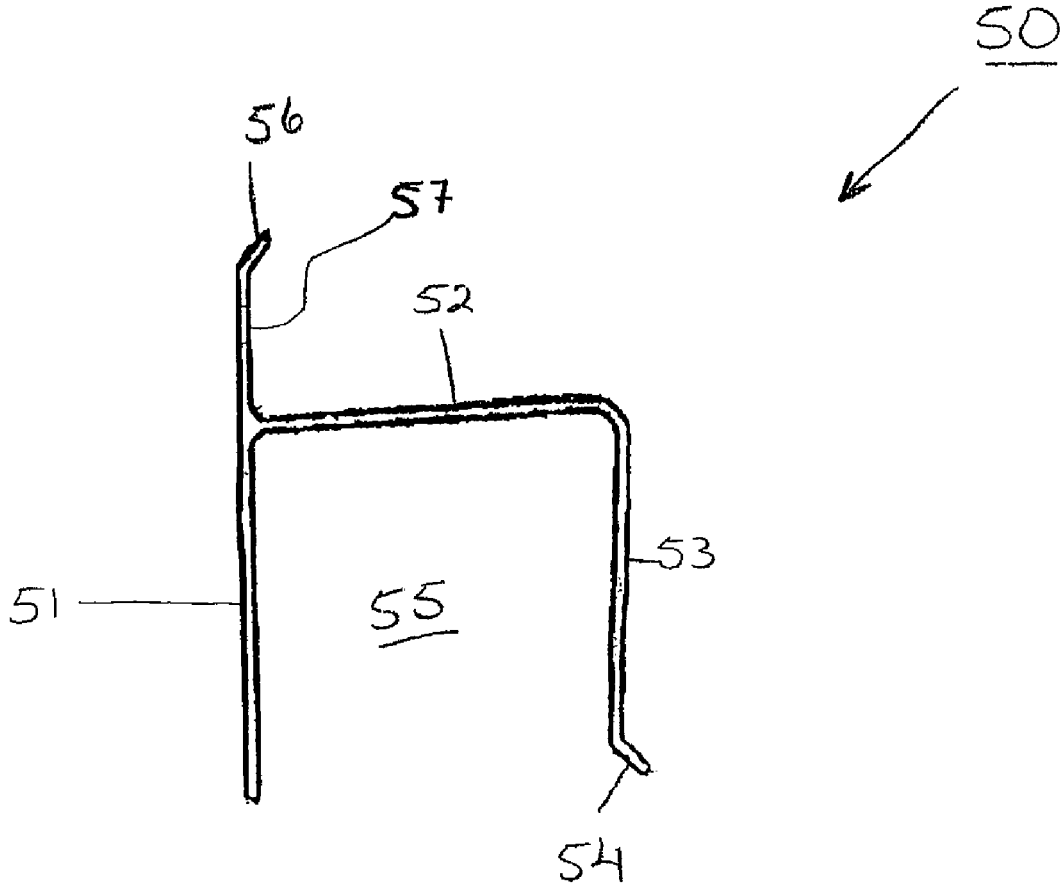
FIG. 5 is an end view of an H-header mounting extrusion.
Figure 9:
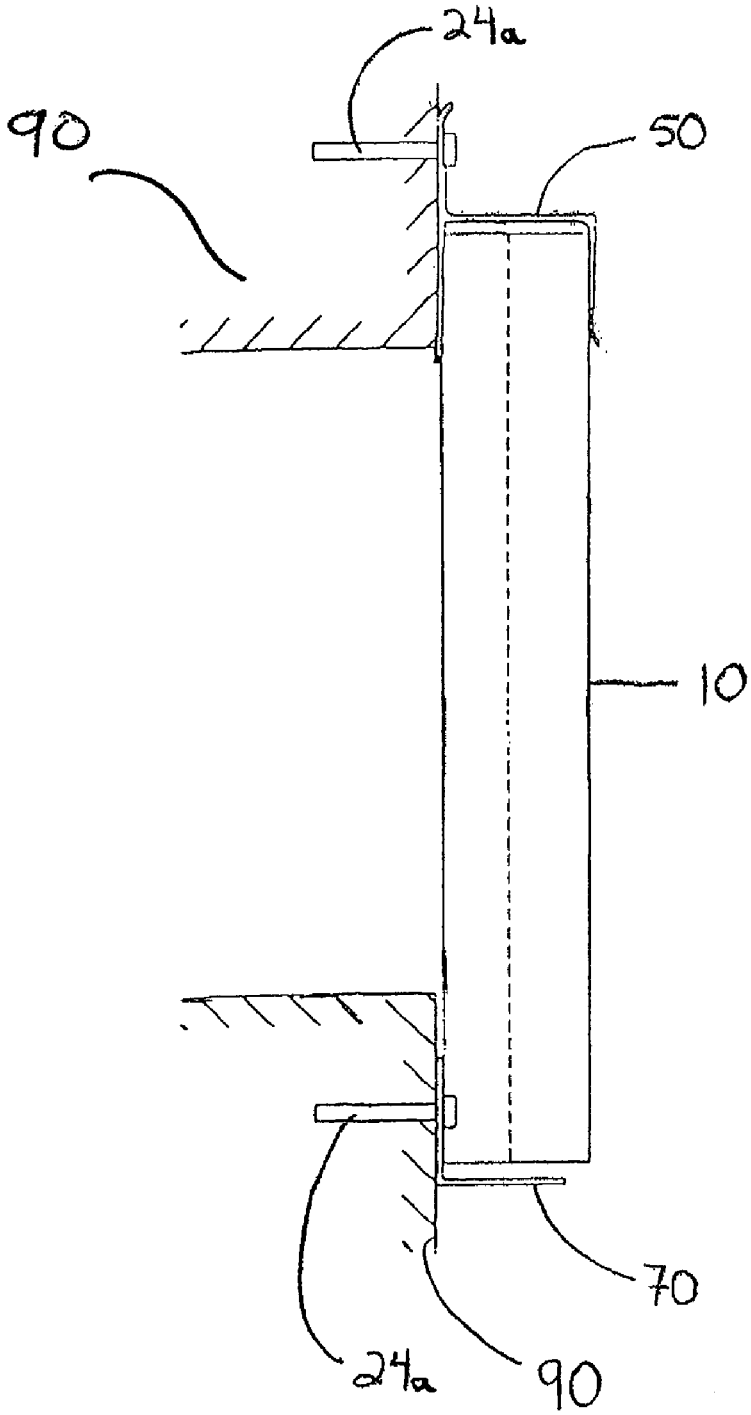
FIG. 9 is a side-elevational view of a storm panel mounted to a mounting surface, such as the side of a building, using an H-header and a studded angle mounting extrusion.

Turning next to FIGS. 5 and 9, another configuration of an extrusion for use with the storm panels 10 of the present invention, an H-header extrusion 50, is illustrated. The H-header extrusion 50 includes a mounting arm 51, a extension arm 52 connected to and extending from the mounting arm 51, and a panel retention arm 53 connected to and extending from the extension arm 52. The mounting arm 51, extension arm 52, and panel retention arm 53 are configured to provide a cavity 55 for receiving and retaining a storm panel 10. The panel retention arm 53 may have an angled tip 54. As discussed above with regard to the angled tip 84, the tip 54 not only ensures a snug fit by easing the panel into the cavity 55, but tip 54 also protects the storm panel 10 from blowing away in high winds. The mounting arm 51 may also have an angled tip 56. The mounting arm 51 of extrusion 50 may also include a mounting feature, such as a slot or hole 57, in the mounting arm 51 to allow a fastener 24*a* to secure the extrusion 50 onto a supporting structure 90. As illustrated in FIG. 9, the H-header extrusion 50 may be used in combination with other extrusions, such as a studded angle mounting extrusion 70.

Figure 7:
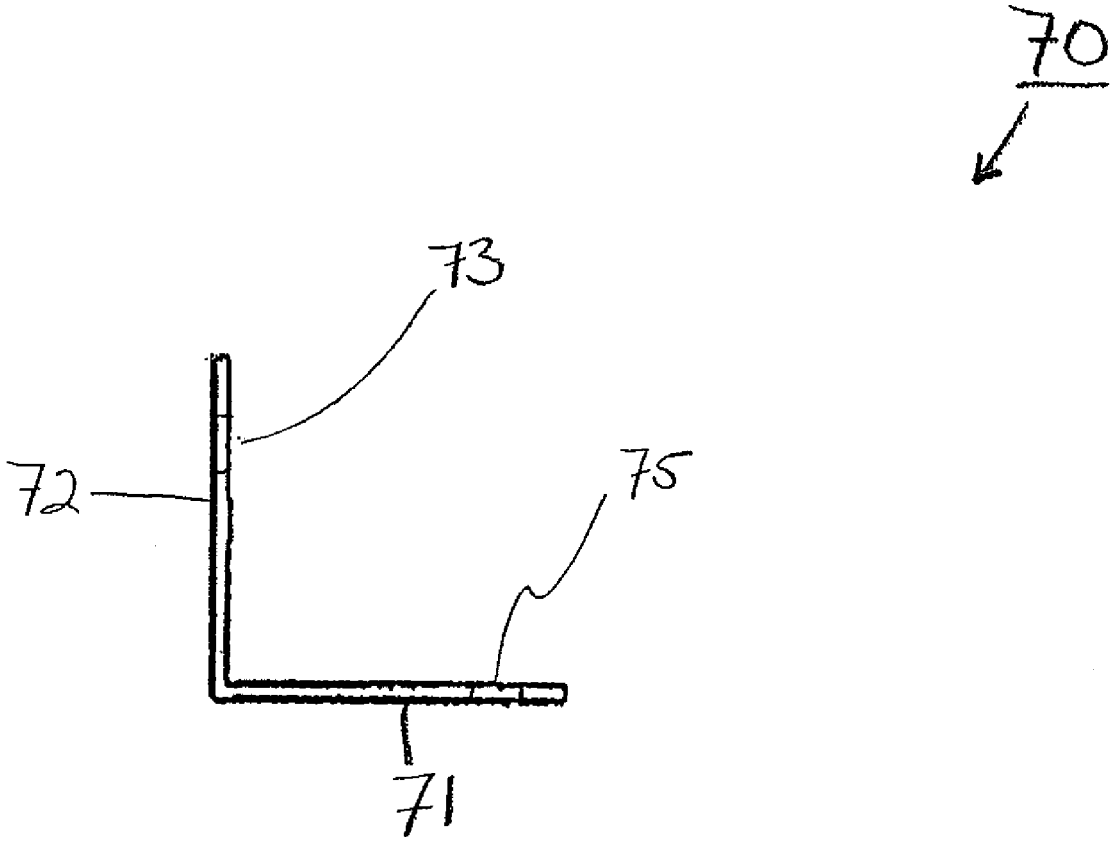
FIG. 7 is an end view of a studded angle mounting extrusion.

The studded angle extrusion 70 has a first arm 71 and a second arm 72 extending from the first arm, FIG. 7. At least one mounting feature, such as a hole or slot 73, for receiving a fastener 24*a* may be provided in the studded angle extrusion 70 on either the first arm 71 or the second arm 72. Alternatively, both the first arm 71 and the second arm 72 can each have at least one slot 73, 75. Specifically, a fastener 24*a* can slide through a slot 73 on the second arm 72 of extrusion 70, thereby affixing storm panel 10 to the extrusion 70, FIG. 9. A second fastener 27 can slide through another slot 75 on the first arm 71 thereby mounting the extrusion and the panel 10 to a threshold 100, FIG. 11. Further, a fastener 24*b* can secure the bolt 24*a* fastening together the panel 10 and the studded angle extrusion 70. The studded angle extrusion 70 can also be used to close off an edge of a sheet of panels 10, FIGS. 16A and 16B. For instance, a first arm 71 can be fastened to a storm panel 10, while a second arm 72 is fastened to a concrete wall. In this instance, the extrusion 70 can have an elongated second arm.

Figure 11:
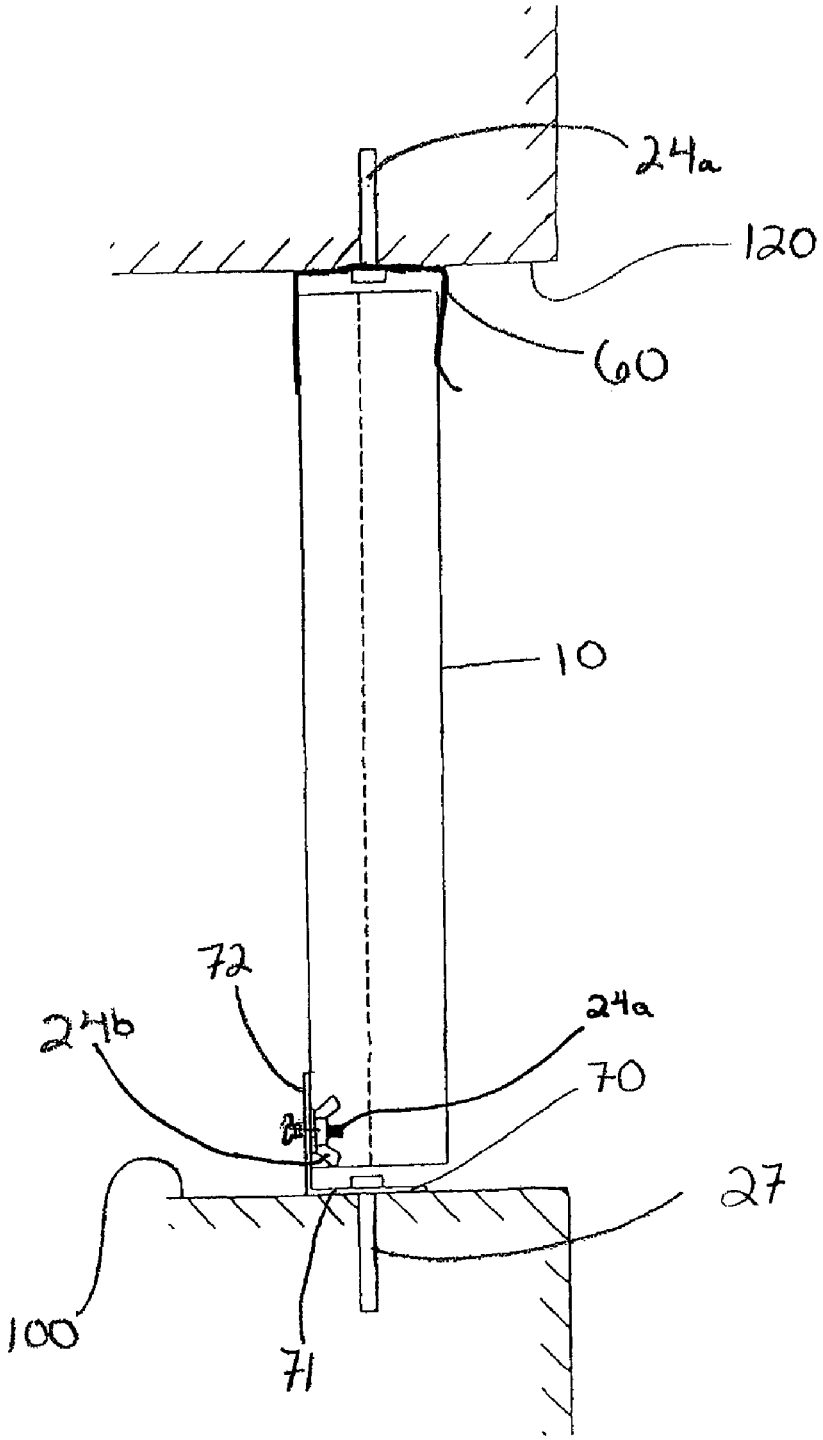
FIG. 11 is a side-elevational view of a storm panel mounted to a mounting surface, such as a lintel or threshold, using a U-header and a studded angle mounting extrusion.
Figure 13:
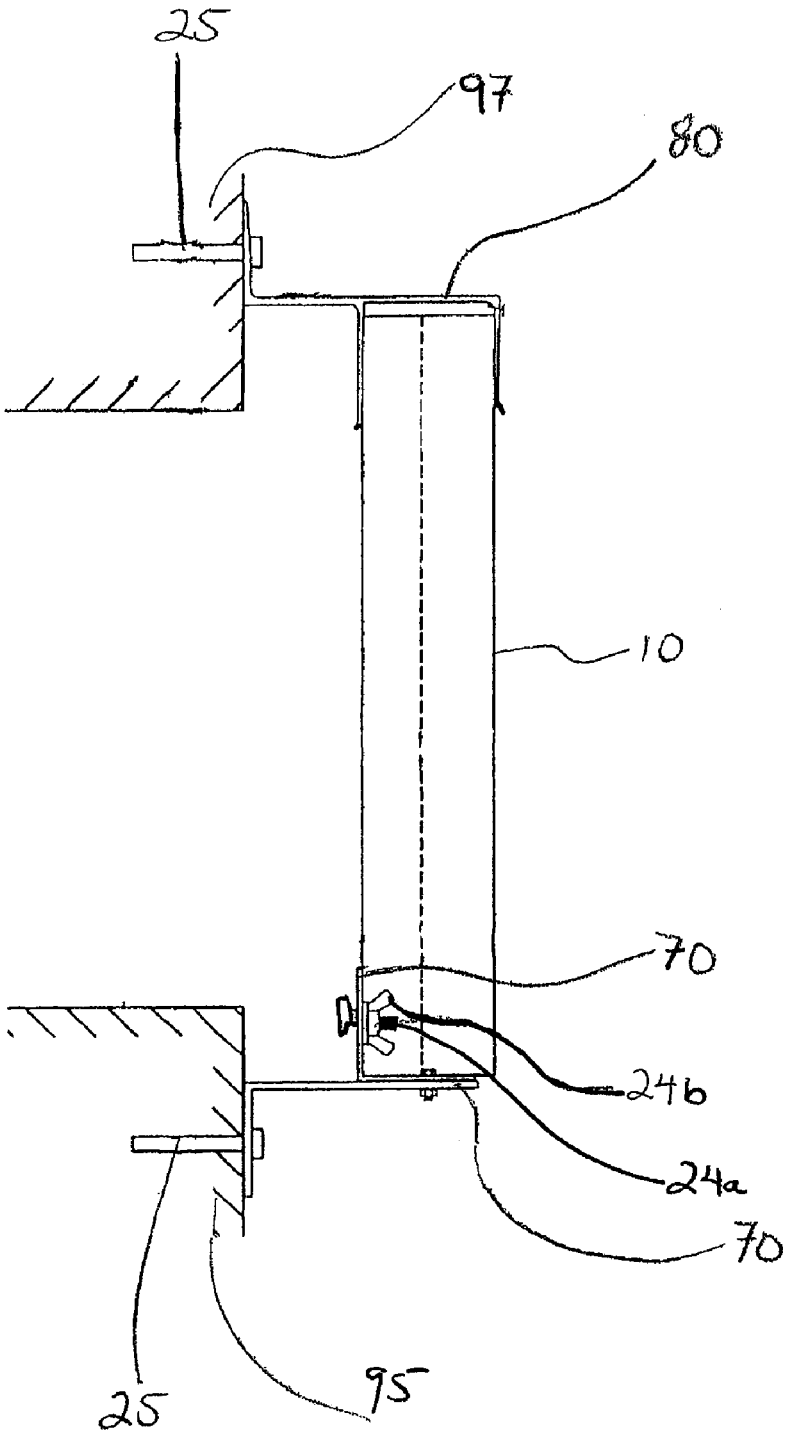
FIG. 13 is a side-elevational view of a storm panel mounted to a mounting surface, such as a side of a building, using a build-out H-header and multiple studded angle mounting extrusions.
Figure 14:
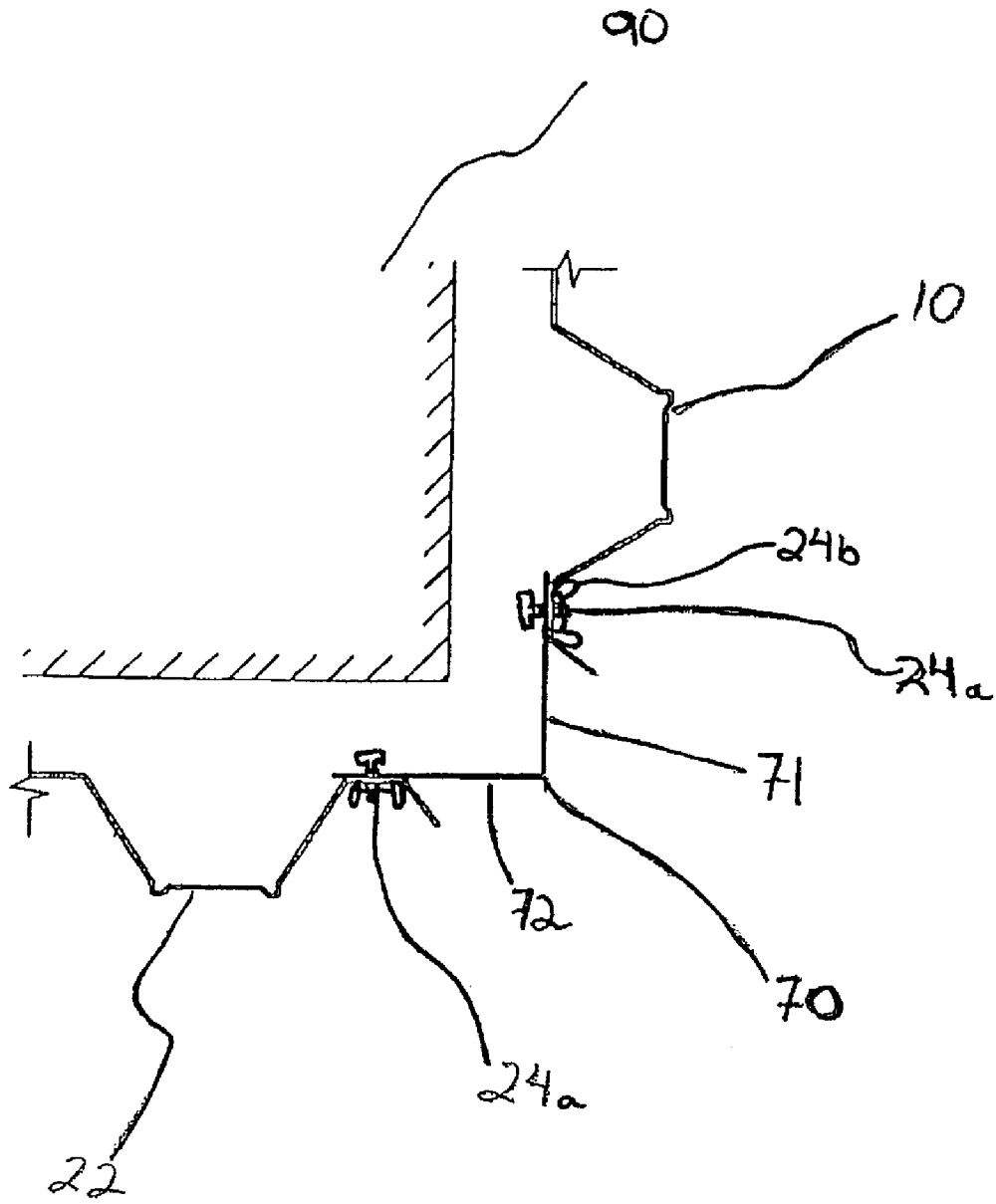
FIG. 14 is a side-elevational view of a corner support joining two panels mounted onto a mounting surface, such as a side of a building, using a studded angle mounting extrusion.
Figure 16A:
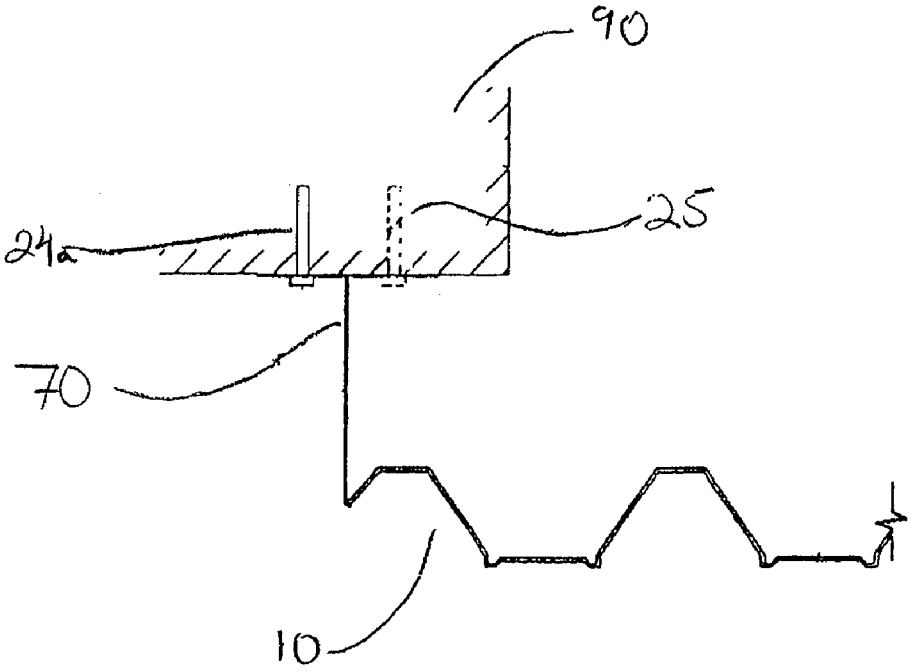
FIG. 16A is a side-elevational view of a storm panel mounted to a mounting surface, such as a side of a building, having a build out end closure using a studded angle mounting extrusion.
Figure 16B:
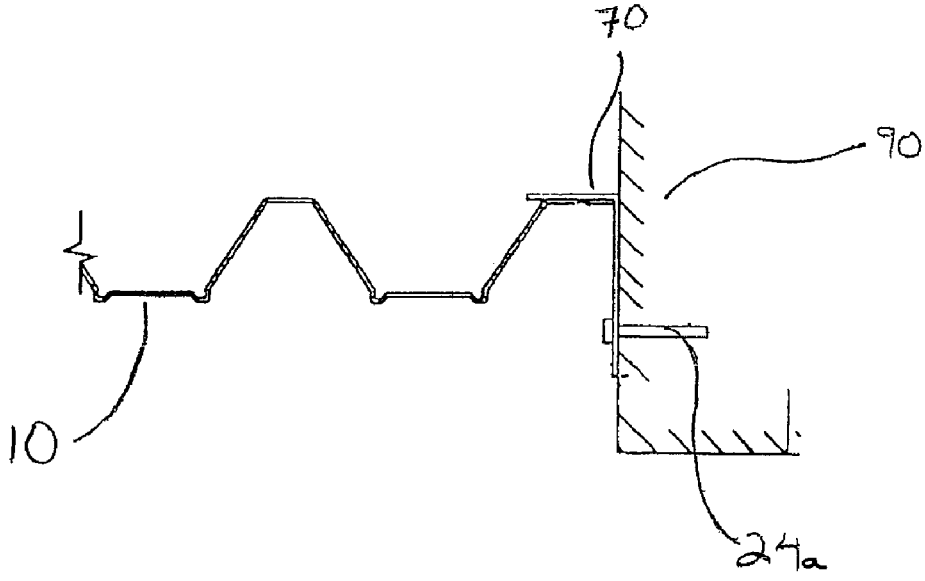
FIG. 16B is a side-elevational view of a storm panel mounted to a mounting surface, such as a side of a building, having an inside mount closure using a studded angle mounting extrusion.

The studded angle extrusion 70 can be used alone, or in combination with other extrusions including any of those listed above, such the H-header extrusion 50 or U-header extrusion 60, to secure a storm panel 10 to a surface, FIGS. 9, 11. Additionally, the build-out H-header mounting extrusion 80 may mount one end of storm panel 10 while the other end of storm panel 10 is mounted to multiple studded angle extrusions 70, FIG. 13. The upper portion of panel 10 is clipped into build-out H-header mounting extrusion 80, which is fastened into a structure 97 by a fastener 25. The lower portion of panel 10 is fastened to a first studded angle extrusion 70 by fasteners 24*a*, 24*b*. The first studded angle extrusion is connected to a second studded angle extrusion 70, which in turn is fastened onto a structure 95 by a fastener 25. While FIG. 13 provides an example where multiple studded angle extrusions 70 may be used together to mount a panel 10 onto a mounting surface, one or more studded angle extrusions 70 may also be used as a corner support for panels placed over an external corner of a structure, FIG. 14. A studded angle 70 may connect a first panel 10 and a second panel 22. Fasteners 24*a*, 24*b* can join the first panel 10 to the first arm 71 of the studded angle mounting extrusion 70 and the second panel 22 to the second arm 72 of the studded angle mounting extrusion 70. As noted above, in yet another configuration, a studded angle mounting extrusion 70 could be used as an end closure of mounted panels. In FIG. 16A, studded angle mounting extrusion 70 may be connected to a supporting structure 90 with a fastener 24 to provide build out and closure. While the studded angle mounting extrusion 70 can be mounted to the structure 90 using fastener 24*a*, the studded angle extrusion 70 can alternatively be mounted to the structure 90 at an interior position, e.g., with fastener 25.

Figure 6:
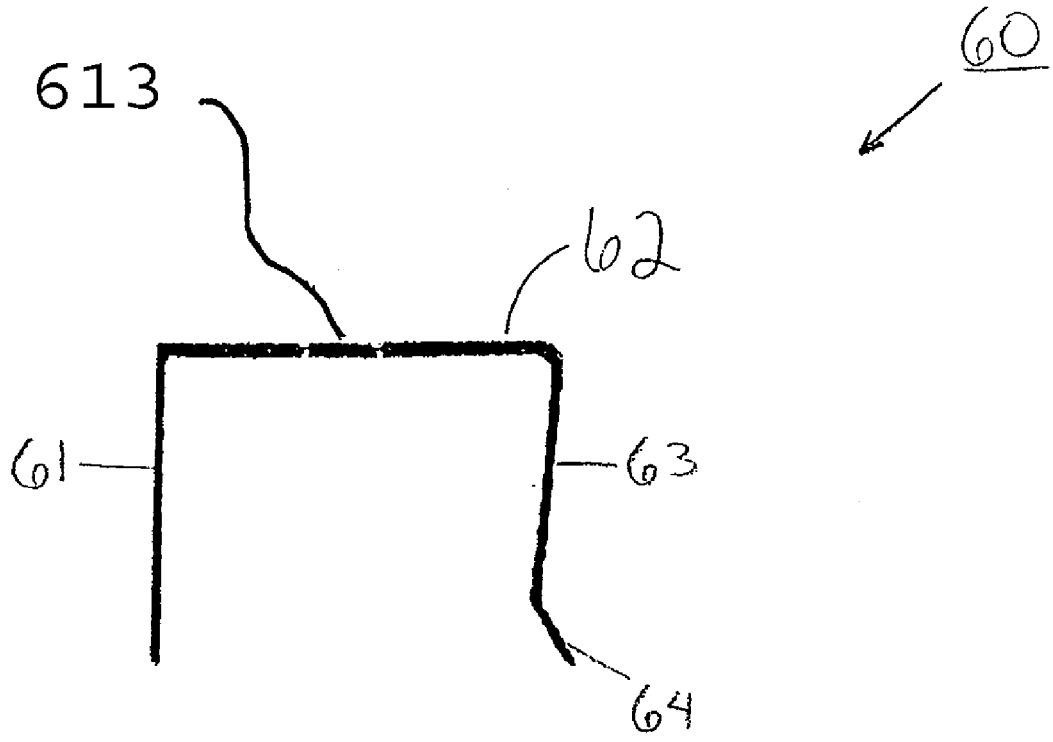
FIG. 6 is an end view of a U-header mounting extrusion.
Figure 15:
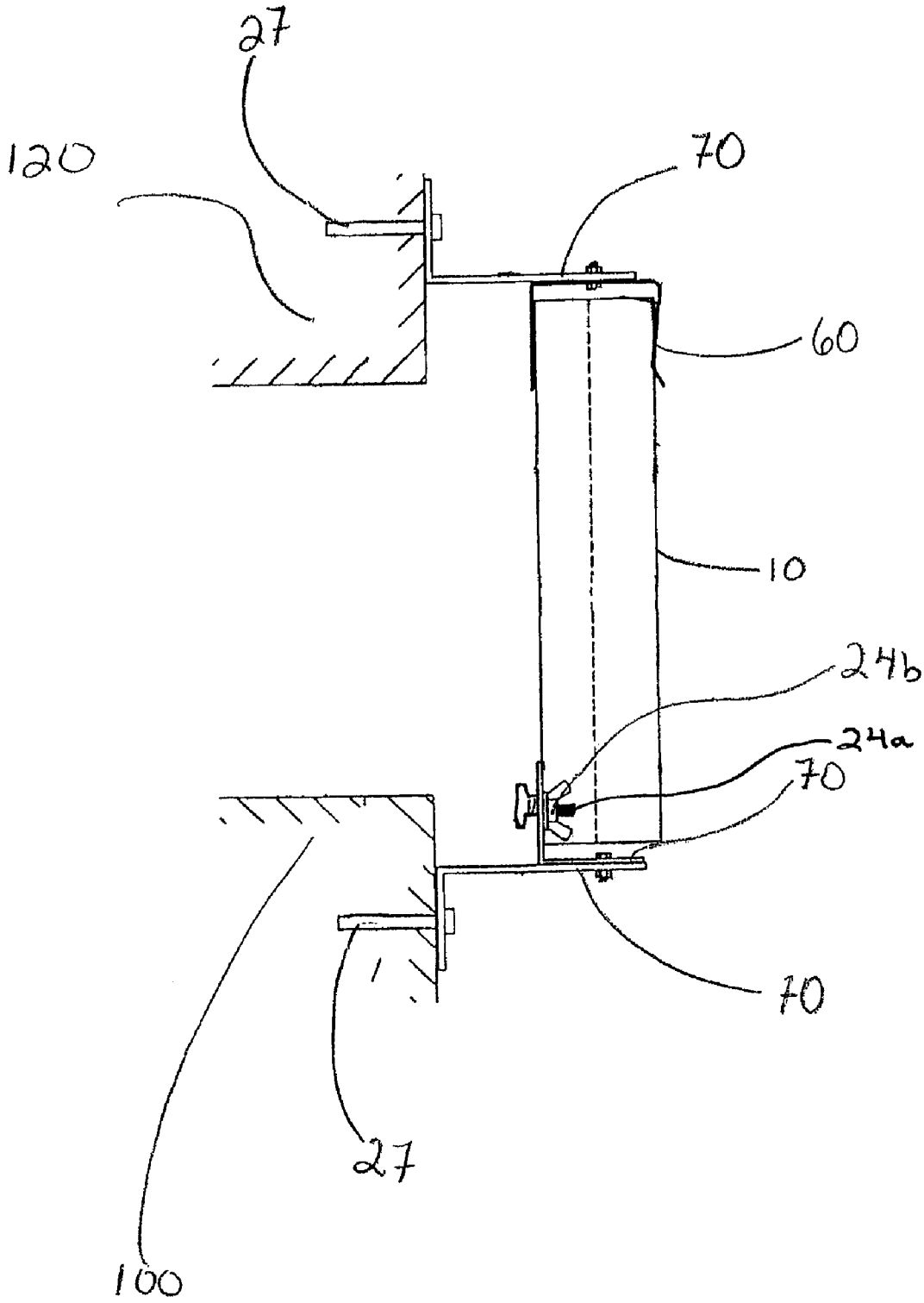
FIG. 15 is a side-elevational view of a storm panel mounted to a mounting surface, such as a side of a building, using a U-header mounting extrusion joined to a studded angle mounting extrusion at one end of the panel and multiple joined studded angle mounting extrusions at another end of the panel.

FIG. 6 depicts a U-header extrusion 60 which has a first arm 61, a second arm 62 extending from first arm 61, and a third arm 63 extending from the second arm 62 to provide a generally U-shaped region between a first, second, and third arms 61, 62, 63. The third arm 63 may have an angled tip 64, similar to that discussed above with regard to the angled tip 84. Specifically, the tip 64 can perform a camming function to create a snug fit between the panel 10 and the U-header extrusion 60. For example, the U-header extrusion 60 can be used to mount one end of storm panel 10 to a horizontal surface, such as a lintel 120 or threshold 100, FIG. 11. The second arm 62 of the U-header extrusion 60 can have a slot 613 through which a fastener 24*a* can attach the extrusion to the lintel 120. The first arm 61 and the third arm 63 of U-header extrusion 60 surround the end of the storm panel 10, thereby clipping the panel 10 in place. The other end of storm panel 10 may be fastened into a studded angle extrusion 70 through a slot in the second arm 72 by fasteners 24*a*, 24*b*, FIG. 11. The first arm 71 of the studded angle extrusion 70 is fastened to the threshold 100 by a second fastener 27 in a second slot. Optionally, the first arm 71 of extrusion 70 can be elongated. Further, extrusions 60 and 70 can be used in combination to mount one end of storm panel 10 while the other end of storm panel 10 can be mounted by a combination of two extrusions 70, FIG. 15. The panel 10 clips into the U-header extrusion 60, which in turn connects to the studded angle extrusion 70. The combination of the panel, U-header extrusion 60, and studded angle mounting extrusion 70 is fastened to a lintel 120. The lower portion of panel 10 is fastened into a first lower studded angle extrusion 70 by fasteners 24*a*, 24*b*. The first lower studded angle extrusion 70 is connected to a second lower studded angle 70, which in turn is connected to threshold 100 by fastener 27.

It will be recognized by those skilled in the art that changes or modifications may be made to the above-described configurations without departing from the broad inventive concepts of the invention. It should therefore be understood that this invention is not limited to the particular configurations described herein, but is intended to include all changes and modifications that are within the scope and spirit of the invention as set forth in the claims.

What is claimed is:

1. A storm panel having at least one corrugation comprising:

a. a first wall and a second wall disposed in spaced-apart relation, the first wall for positioning proximate a mounting surface and the second wall for positioning outwardly from the mounting surface;

b. an angled wall disposed between and connected to the first wall and the second wall to support the second wall away from the first wall; and c. at least one ridge disposed at the point of connection between the second wall and the angled wall to connect the second wall to the angled wall, the ridge projecting outwardly from the second wall and away from the first wall; and wherein the ridge comprises a first end disposed in contact with the second wall, a second end disposed in contact with the angled wall and an intermediate wall disposed between the first ridge end and second ridge end, wherein the first end of the ridge projects outwardly away from the second wall at an angle relative to the second wall and wherein the second end of the ridge projects outwardly from the angled wall at an orientation generally perpendicular to the second wall and wherein further said intermediate wall of the ridge is oriented generally parallel to the second wall at an orientation outwardly away from the second wall.

2. The storm panel of claim 1, wherein the intermediate wall is generally flat and extends between the first and second ends of the ridge in an orientation generally parallel with the first wall.

3. The storm panel of claim 1, wherein the first end of the ridge is disposed in contact with the angled wall.

4. The storm panel of claim 1, comprising a mounting feature for mounting the storm panel to a mounting surface.

5. The storm panel of claim 4, wherein the mounting feature comprises a slot disposed in the first wall for receiving a fastener.

6. The storm panel of claim 1, wherein the panel comprises a polymeric material.

7. The storm panel of claim 6, wherein the panel comprises a plastic material.

8. The storm panel of claim 1, wherein the at least one ridge has a shape configured to strengthen the panel proximate the point of connection between the second wall and the angled wall.

9. A storm panel assembly comprising:

a. a storm panel having at least one corrugation and including:

i. a first wall and a second wall disposed in spaced-apart relation, the first wall for positioning proximate a mounting surface and the second wall for positioning outwardly from the mounting surface;

ii. an angled wall disposed between and connected to the first wall and the second wall to support the second wall away from the first wall; and iii. at least one ridge disposed at the point of connection between the second wall and the angled wall to connect the second wall to the angled wall, the ridge projecting outwardly from the second wall and away from the first wall, and wherein the ridge comprises a first end disposed in contact with the second wall, a second end disposed in contact with the angled wall, and an intermediate wall disposed between the first ridge end and the second ridge end, wherein the first end of the ridge projects outwardly away from the second wall at an angle relative to the second wall and wherein the second end of the ridge projects outwardly from the angled wall at an orientation generally perpendicular to the second wall and wherein further said intermediate wall of the ridge is oriented generally parallel to the second wall at an orientation outwardly away from the second wall; and b. a mounting extrusion for attachment to the at least one storm panel to provide support for the at least one storm panel on the mounting surface.

10. The assembly of claim 9, wherein the mounting extrusion includes:

a. a cavity dimensioned to receive a fastener and having a slot configured to permit the fastener to extend therethrough for attachment to the at least one storm panel; and b. a mounting arm extending away from the cavity for mounting to the mounting surface.

11. The assembly of claim 10, wherein the mounting extrusion includes an extension arm disposed between the mounting arm and the cavity.

12. The assembly of claim 9, wherein the mounting extrusion includes:

a. a mounting arm for mounting to the mounting surface;

b. an extension arm connected to and extending away from the mounting arm; and c. a panel retention arm connected to and extending away from the extension arm, the mounting arm, extension arm, and panel retention arm cooperating to provide a cavity for receiving the at least one storm panel.

13. The assembly of claim 12, wherein the extension arm is connected to the mounting arm at an end of the mounting arm.

14. The assembly of claim 12, wherein the extension arm is connected to the mounting arm at a point between the two ends of the mounting arm.

15. The assembly of claim 12, wherein at least one of the end of the mounting arm and the end of the panel retention arm includes an angled end portion.

16. The assembly of claim 9, wherein the mounting extrusion includes:

a. a mounting arm for mounting to the mounting surface;

b. an extension arm connected to and extending away from the mounting arm;

c. first and second panel retention arms connected to and extending away from the extension arm, the extension arm and panel retention arms cooperating to provide a cavity for receiving the at least one storm panel.

17. The assembly of claim 9, wherein the at least one storm panel comprises a polymeric material.

18. The storm panel of claim 9, wherein the panel comprises a plastic material.

19. The storm panel of claim 9, wherein the at least one ridge has a shape configured to strengthen the panel proximate the point of connection between the second wall and the angled wall.

* * * * *